US011371507B2

(12) United States Patent
Broucke et al.

(10) Patent No.: US 11,371,507 B2
(45) Date of Patent: Jun. 28, 2022

(54) OIL-INJECTED MULTISTAGE COMPRESSOR DEVICE AND METHOD FOR CONTROLLING SUCH A COMPRESSOR DEVICE

(71) Applicant: ATLAS COPCO AIRPOWER, NAAMLOZE VENNOOTSCHAP, Wilrijk (BE)

(72) Inventors: Stijn Broucke, Wilrijk (BE); Pieter De Schamphelaere, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 17/268,792

(22) PCT Filed: Sep. 24, 2019

(86) PCT No.: PCT/IB2019/058063
§ 371 (c)(1),
(2) Date: Feb. 16, 2021

(87) PCT Pub. No.: WO2020/065505
PCT Pub. Date: Apr. 2, 2020

(65) Prior Publication Data

US 2021/0246900 A1 Aug. 12, 2021

(30) Foreign Application Priority Data

Sep. 25, 2018 (BE) ..... 2018/5658

(51) Int. Cl.
*F04C 29/02* (2006.01)
*F04C 29/04* (2006.01)
(Continued)

(52) U.S. Cl.
CPC ..... *F04C 29/042* (2013.01); *F04C 28/00* (2013.01); *F04C 29/026* (2013.01);
(Continued)

(58) Field of Classification Search
CPC .... F04C 29/026; F04C 29/028; F04C 29/048; F04C 29/04; F04C 28/00; F04C 28/02;
(Continued)

(56) References Cited

U.S. PATENT DOCUMENTS 3,759,052 A 9/1973 Inoue
6,506,027 B1 * 1/2003 Timuska ..... F04C 29/042 62/84

(Continued)

FOREIGN PATENT DOCUMENTS

CN 204716541 U 10/2015
CN 105275810 A 1/2016

(Continued)

OTHER PUBLICATIONS

International Search Report for PCT/IB2019/058063 dated Dec. 16, 2019 (PCT/ISA/210).

(Continued)

*Primary Examiner* — Audrey B. Walter
*Assistant Examiner* — Dapinder Singh
(74) *Attorney, Agent, or Firm* — Sughrue Mion, PLLC

(57) ABSTRACT

An oil-injected multistage compressor device that comprises at least one low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) via a conduit (6), characterized in that an intercooler (9) is provided between the low-pressure stage compressor element (2) and the (Continued)

high-pressure stage compressor element (3) in the aforementioned conduit (6) and that the compressor device (1) is also equipped with a restriction (10) for limiting the amount of oil injected in the low-pressure stage compressor element (2).

13 Claims, 1 Drawing Sheet

(51) Int. Cl.
*F04C 23/00* (2006.01)
*F04C 28/00* (2006.01)

(52) U.S. Cl.
CPC ..... *F04C 29/028* (2013.01); *F04C 23/001* (2013.01); *F04C 2270/195* (2013.01)

(58) Field of Classification Search
CPC .. F04C 23/001; F04C 2700/195; F04B 25/00; F04B 25/005
See application file for complete search history.

(56) References Cited

U.S. PATENT DOCUMENTS

| | | | | |
|---|---|---|---|---|
| 8,277,207 | B2 * | 10/2012 | Kishi | F04C 29/02 418/98 |
| 8,313,312 | B2 * | 11/2012 | Fujimoto | F04C 23/001 418/201.1 |
| 2004/0217180 | A1 | 11/2004 | Lu | |

FOREIGN PATENT DOCUMENTS

| | | | |
|---|---|---|---|
| CN | 107002683 | A | 8/2017 |
| JP | 05-044678 | A | 2/1993 |
| WO | 02/25115 | A1 | 3/2002 |

OTHER PUBLICATIONS

Written Opinion for PCT/IB2019/058063 dated Dec. 16, 2019 (PCT/ISA/237).

* cited by examiner

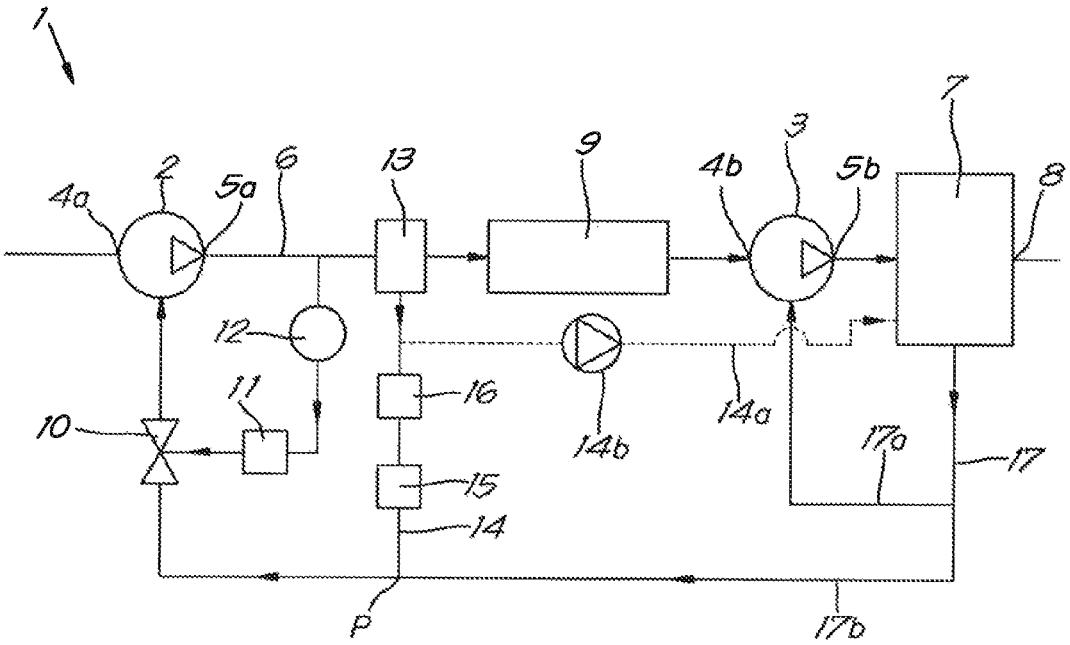
1
2
3
4a
4b
5a
5b
6
7
8
9
10
11
12
13
14
14a
14b
15
16
17
17a
17b
P

OIL-INJECTED MULTISTAGE COMPRESSOR DEVICE AND METHOD FOR CONTROLLING SUCH A COMPRESSOR DEVICE

CROSS REFERENCE TO RELATED APPLICATIONS

This application is a National Stage of International Application No. PCT/IB2019/058063 filed Sep. 24, 2019, claiming priority based on Belgian Patent Application No. 2018/5658 filed Sep. 25, 2018.

The present invention relates to an oil-injected multistage compressor.

People are already aware of multistage compressor devices in which gas is compressed in two or more steps or 'stages', whereby two or more compressor elements are placed in a series one after the other.

People are also already aware of oil-injected multistage compressor devices in which a coolant, in this case oil, is used to cool the gas.

This makes improved efficiency possible, since the consumption of the second and subsequent stages will decrease by cooling the gas before the second and subsequent stages.

The cooling of the gas, and therefore the improvement in efficiency, could be much better.

The cooling could be improved by, for example, additional active cooling. This entails effectively extracting heat from the system instead of only adding a coolant to the system that takes heat from the gas.

Such active cooling offers much more potential for increasing efficiency.

However, this is not as simple as it would appear since there will be a pressure loss in a cooler, which will undo the improved efficiency.

This pressure loss increases due to the presence of oil in the gas, particularly due to the fact that the oil has a higher viscosity than air. The pressure loss will depend on the quantity of oil in the gas: the more oil in the gas, the greater the pressure loss in the intercooler.

The object of the present invention is to provide a solution to at least one of the aforementioned and other disadvantages by providing an oil-injected multistage compressor device, in which there will be an active cooling for which the aforementioned pressure loss will not be a problem.

The subject of the present invention is an oil-injected multistage compressor device that comprises at least one low-pressure stage compressor element with an inlet and an outlet and a high-pressure stage compressor element with an inlet and an outlet, whereby the outlet of the low-pressure stage compressor element is connected to the inlet of the high-pressure stage compressor element by a conduit, with the characteristic that in the aforementioned conduit between the low-pressure stage compressor element and the high-pressure stage compressor element an intercooler is provided and that the compressor device is also equipped with a restriction for limiting the amount of oil injected into the low-pressure stage compressor element.

An advantage is that the restriction can limit the amount of oil injected into the low-pressure stage compressor element.

This results in the pressure loss in the intercooler being limited.

Therefore, one will achieve all the advantages of the active cooling of the gas for the high-pressure stage, without or with only a limited disadvantage of a pressure loss in the intercooler.

The restriction can be implemented in many ways, such as a local constriction in the relevant oil supply conduit.

The restriction is preferably done by a valve that can regulate the amount of oil injected into the low-pressure stage compressor element, so that always only the minimum amount of the required oil is injected and not more than necessary.

This will limit the aforementioned pressure loss in the cooler even more.

When conditions demand, the valve can allow more oil to be injected in order to avoid overheating. In all other cases, it is possible to switch to the minimum injection.

The presence of the intercooler means that less oil is needed for cooling, since the intercooler can take over part of the cooling that was previously done by the oil. Because less oil is needed and injected, the pressure loss in the intercooler will also be limited.

It is possible for the compressor device to be equipped with an oil separator provided in the conduit upstream from the intercooler in order to separate oil.

The advantage of this is that it can ensure that no, or virtually no, oil will enter the intercooler, such that the problem of pressure loss may be completely eliminated.

This also results in the possibility of separating any condensate forming in the intercooler.

When the oil is not separated before the intercooler, this condensate would end up in the oil and it would then be difficult to separate it apart.

The invention also relates to a method for controlling an oil-injected multistage compressor device that comprises at least one low-pressure stage compressor element with an inlet and an outlet and a high-pressure stage compressor element with an inlet and an outlet, whereby the outlet of the low-pressure stage compressor element is connected to the inlet of the high-pressure stage compressor element via a conduit, with the characteristic that in the aforementioned conduit between the low-pressure stage compressor element and the high-pressure stage compressor element an intercooler is provided and that the compressor device is also equipped with a restriction for limiting the amount of oil injected into the low-pressure stage compressor element and with the characteristic that the method comprises the following steps:

- measuring or determining either the power, the efficiency, or the temperature at the outlet of the low-pressure stage compressor element;
- opening, or further opening, the valve if the measured or determined power, efficiency, or temperature is higher than a predetermined value.
- closing, or further closing, the valve if the measured or determined power, efficiency, or temperature is equal to or less than a predetermined value ($T_{max}$).

The advantages of such a method are obviously similar to the aforementioned advantages of the oil-injected multistage compressor device.

With the insight to better demonstrate the features of the invention, the following describes, as a non-exhaustive example, some preferred embodiments of an oil-injected multistage compressor device according to the invention and method in order to control such a compressor device, with reference to the accompanying drawings, in which:

FIG. 1 shows the schematic for an oil-injected multistage compressor device according to the invention;

The FIG. 1 schematic for the oil-injected multistage compressor device 1 comprises two steps or 'stages' in this case: a low-pressure stage with a low-pressure stage compressor element 2 and a high-pressure stage with a high-pressure stage compressor element 3.

Both compressor elements 2, 3 are, for example, screw compressor elements, but this is not necessary for the invention.

Both compressor elements 2, 3 are also provided with an oil circuit for the injection of oil in compressor elements 2, 3. For clarity, these oil circuits are not or only partially shown in the FIGURE.

Low-pressure stage compressor element 2 has an inlet 4*a* for gas and an outlet 5*a* for compressed gas.

Gas outlet 5*a* is connected to inlet 4*b* of high-pressure stage compressor element 3 via a conduit 6.

High-pressure stage compressor element 3 is also equipped with an outlet 5*b*, whereby outlet 5*b* is connected to a liquid separator 7.

It is possible for outlet 8 of this liquid separator 7 to be connected to an aftercooler.

An intercooler 9 is included in the aforementioned conduit 6 between low-pressure stage compressor element 2 and high-pressure stage compressor element 3.

Compressor device 1 is also equipped with a restriction 10 for limiting the quantity of oil injected into low-pressure stage compressor element 2.

In this case, but not necessarily for the invention, this restriction 10 is carried out with a valve 10, which will allow the regulation of the amount of oil to be injected.

Of course it is not excluded that a passive or non-regulatable restriction 10 is applied instead of a valve 10, for example in the form of a narrowing in the conduit at the point where valve 10 is usually located.

The aforementioned valve 10 can be an open-closed regulatable valve or a continuously regulatable valve.

A control unit or regulator 11 is provided for controlling or regulating this valve 10.

In this case, a temperature sensor 12 is also provided which may determine or measure the temperature at outlet 5*a* of low-pressure stage compressor element 2. This sensor 12 is connected to the aforementioned control unit or regulator 11.

It is also possible to use a power meter or an efficiency meter instead of a temperature sensor 12.

In this case, but not necessarily for the invention, compressor device 1 is equipped with an oil separator 13, which is provided in conduit 6 upstream from intercooler 9 for separating the oil that is injected into low-pressure stage compressor element 2. An oil conduit 14 is also provided which runs from this oil separator 13 towards low-pressure stage compressor element 2 in order to direct the oil separated by oil separator 13 via this oil conduit 14 to low-pressure stage compressor element 2 to be injected into the low-pressure stage compressor element 2 there.

This means that this oil conduit 14 runs towards the aforementioned valve 10.

Alternatively, it is also possible for this oil conduit 14 to run from oil separator 13 to liquid separator 7 downstream from high-pressure stage compressor element 3.

This is shown schematically using the dotted line 14*a*, which represents this oil conduit 14*a*.

Such an oil conduit 14*a* will guide the oil separated by oil separator 13 via this oil conduit 14*a* to liquid separator 7. It is not excluded for an oil pump 14*b* or the like to be used for displacing the oil.

In this case, both an oil cooler 15 and a filter 16 will be provided in oil conduit 14.

The filter 16 can filter out any impurities in the oil before the oil is reinjected into compressor element 2.

An oil return conduit 17 is also provided, which leaves from liquid separator 7 with a branch 17*a* to high-pressure stage compressor element 3 and a branch 17*b* to low-pressure stage compressor element 2.

As can be seen in FIG. 1, oil conduit 14 joins with branch 17*b* at point P, whereby the aforementioned oil cooler 15 and filter 16 are included upstream from point P in oil conduit 14.

Naturally, this is not necessarily the case and both the oil cooler 15 and filter 16 can be included downstream from point P in oil conduit 14, so that both the oil from liquid separator 7 and the oil from oil separator 13 are cooled and filtered by oil cooler 15 and filter 16 respectively.

If oil conduit 14*a* is provided, it can also be provided with an oil cooler 15 and a filter 16.

The operation of the oil-injected multistage compressor device 1 is very simple and is as follows:

During operation, compressed gas, e.g. air, will be sucked in via inlet 4*a* of low-pressure stage compressor element 2 and will undergo a first compression stage.

The partially compressed gas will flow through conduit 6 to intercooler 9, where it will be cooled and then flow to inlet 4*b* of high-pressure stage compressor element 3, where it will undergo a subsequent compression.

Oil will be injected in both low-pressure stage 2 and high-pressure stage compressor element 3, which will ensure the lubrication and cooling of compressor elements 2, 3.

The compressed gas will leave high-pressure stage compressor element 3 via outlet 5*b* and be guided to oil separator 7.

The injected oil will be separated and the compressed gas can then possibly be guided to an aftercooler before being sent to consumers.

To ensure that there is not a big pressure loss in intercooler 9, valve 10 will be controlled by control unit 11 so that temperature $T_{outlet}$ at outlet 5*a* of low-pressure stage compressor element 2 remains below a specific value $T_{max}$.

For this, the first step will be to determine the temperature $T_{outlet}$.

This temperature $T_{outlet}$ will in this case be measured directly with sensor 12.

However, it is clear that there are other ways to determine this temperature $T_{outlet}$. For example, it can also be determined or calculated from the temperature after intercooler 9 or based on environmental parameters and working conditions of low-pressure stage compressor element 2.

The method for controlling valve 10 is then further as follows:

- opening or further opening of valve 10 if the measured or determined temperature $T_{outlet}$ is higher than a predetermined value $T_{max}$;
- closing or further closing of valve 10 if the measured or determined temperature $T_{outlet}$ is equal to or less than a predetermined value $T_{max}$.

In this way, oil or additional oil can be injected when needed so that the temperature does not increase too much.

At times when the temperature is low enough, the oil injection can be reduced or stopped again.

If valve 10 is an open-closed valve, oil will either be injected or not.

If valve 10 is continuously regulatable, the flow rate of the oil can be precisely adjusted to meet the current requirement.

This ability to regulate ensures that a minimum oil injection is always obtained.

Although the regulation of valve 10 in the example described above is carried out on the basis of the temperature $T_{outlet}$, it is not excluded for the control to be based on the power or efficiency.

In such cases, valve 10 will be controlled by control unit 10 so that the power or efficiency remains above a certain value $P_{max}$ or $E_{max}$, to ensure that there is no large loss of pressure in intercooler 9.

In addition to the control of valve 10, the method in this case will also include the step of separating oil downstream of low-pressure stage compressor element 2 and upstream of intercooler 9 with the help of oil separator 13.

This separated oil will then be discharged to low-pressure stage compressor element 2 via oil conduit 14.

Oil conduit 14 will meet branch 17*b* of return conduit 17 at point P in order to go to valve 10 and ultimately to low-pressure stage compressor element 2.

Alternately, if compressor device 1 is equipped with an oil conduit 14*a*, the method can include the step of separating the oil downstream from low-pressure stage compressor element 2 and upstream from intercooler 9 using oil separator 13 and subsequently pumping this to liquid separator 7 downstream from high-pressure stage compressor element 3.

Due to this additional step, even the minimum injected oil in low-pressure stage compressor element 2 will be removed from the gas, so that there is minimal pressure loss in intercooler 9.

In this way, the gas can always be actively cooled with intercooler 9 before it goes to high-pressure stage compressor element 3 without this being accompanied by significant pressure loss and therefore a loss of efficiency.

The actively cooled air will then be further compressed in high-pressure stage compressor element 3 with a much higher performance than when no intercooler 9 is present.

Another aspect of the invention is that the compressor device is only provided with oil separator 13 with additional oil conduit or 14*a* and not with valve 10 which regulates the oil injection.

In this case, there will therefore be no minimum oil injection, but only all the oil injected in low-pressure stage compressor element 2 will be separated by oil separator 13 before the gas is led to intercooler 9.

The present invention is by no means limited to the embodiments described as examples and shown in the figures, but an oil-injected multistage compressor device according to the invention, and a method for controlling such a compressor device can be achieved following different variants without going beyond the scope of the invention.

The invention claimed is:

1. An oil-injected multistage compressor device that at least comprises a low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) via a conduit (6), characterized in that in the aforementioned conduit (6) between the low-pressure stage compressor element (2) and the high-pressure stage compressor element (3) an intercooler (9) is provided and that the compressor device (1) is also equipped with a restriction (10) for limiting the amount of oil injected in the low-pressure stage compressor element (2).

2. Oil-injected multistage compressor device according to claim 1, characterized in that the restriction (10) is a valve (10).

3. Oil-injected multistage compressor device according to claim 2, characterized in that the valve (10) is an open-closed regulatable valve.

4. Oil-injected multistage compressor device according to claim 2, characterized in that the valve (10) is a continuously regulatable valve.

5. Oil-injected multistage compressor device according to claim 1, characterized in that the compressor device (1) is equipped with an oil separator (13) which is provided in the conduit (6) upstream from the intercooler (9) for separating oil.

6. Oil-injected multistage compressor device according to claim 5, characterized in that the compressor device (1) is equipped with an oil conduit (14) that runs from the oil separator (13) to the low-pressure stage compressor element (2).

7. Oil-injected multistage compressor device according to claim 6, characterized in that an oil cooler (15) and/or a filter (16) is provided in the aforementioned oil conduit (14, 14*a*).

8. Oil-injected multistage compressor device according to claim 5, characterized in that the compressor device (1) is equipped with an oil conduit (14*a*) that runs from the oil separator (13) to a liquid separator (7) which is provided downstream from the high-pressure stage compressor element (3).

9. Oil-injected multistage compressor device according to claim 1, characterized in that the compressor device (1) is further equipped with a control unit or regulator (11) for regulating or controlling the restriction (10) or valve (10) so that the temperature ($T_{outlet}$) at the outlet (5*a*) of the low-pressure stage compressor element (2) remains under a specific value ($T_{max}$) or that the power is minimized or that the efficiency is maximized.

10. Oil-injected multistage compressor device according to claim 9, characterized in that the compressor device (1) is equipped with a temperature sensor (12) that directly measures the temperature ($T_{outlet}$) at the outlet (5*a*) of the low-pressure stage compressor element (2) or that this temperature ($T_{outlet}$) is derived from other parameters.

11. Method for controlling an oil-injected multistage compressor device (1) that comprises at least one low-pressure stage compressor element (2) with an inlet (4*a*) and an outlet (5*a*) and a high-pressure stage compressor element (3) with an inlet (4*b*) and an outlet (5*b*), whereby the outlet (5*a*) of the low-pressure stage compressor element (2) is connected to the inlet (4*b*) of the high-pressure stage compressor element (3) via a conduit (6), characterized in that an intercooler (9) is provided between the low-pressure stage compressor element (2) and the high-pressure stage compressor element (3) in the aforementioned conduit (6) and that the compressor device (1) is also equipped with a restriction (10) for limiting the amount of oil injected in the low-pressure stage compressor element (2) and that the method comprises the following steps:

- measuring or determining the power, efficiency, or temperature ($T_{outlet}$) at the outlet (5*a*) of the low-pressure stage compressor element (2);
- opening or further opening the valve (10) if the measured or determined power, efficiency, or temperature ($T_{outlet}$) is higher than the predetermined value ($T_{max}$);
- closing or further closing the valve (10) if the measured or determined power, efficiency, or temperature ($T_{outlet}$) is equal to or less than the predetermined value ($T_{max}$).

12. Method according to claim 11, characterized in that the method comprises the following steps:

separating oil downstream from the low-pressure stage compressor element (2) and upstream from the intercooler (9);

discharging the separated oil to the low-pressure stage compressor element (2).

13. Method according to claim 11, characterized in that the method comprises the following steps:

separating oil downstream from the low-pressure stage compressor element (2) and upstream from the intercooler (9);

pumping the separated oil to a liquid separator (7) downstream from the high-pressure stage compressor element (3).

* * * * *